US007099608B2

(12) United States Patent
Selinger et al.

(10) Patent No.: US 7,099,608 B2
(45) Date of Patent: Aug. 29, 2006

(54) DEVICE AND METHOD FOR DEVELOPING A CHARGE IMAGE

(75) Inventors: Ralf Selinger, München (DE); Uwe Höllig, München (DE); Stefan Niederhofer, Zorneding (DE)

(73) Assignee: Oce Printing Systems GmbH, (DE)

( * ) Notice: Subject to any disclaimer, the term of this patent is extended or adjusted under 35 U.S.C. 154(b) by 109 days.

(21) Appl. No.: 10/853,471

(22) Filed: May 25, 2004

(65) Prior Publication Data

US 2004/0247342 A1 Dec. 9, 2004

(30) Foreign Application Priority Data

May 27, 2003 (DE) ..... 103 24 077

(51) Int. Cl.
*G03G 15/08* (2006.01)

(52) U.S. Cl. ..... 399/254; 399/256; 399/260

(58) Field of Classification Search ..... 399/119, 399/120, 252, 253, 254, 255, 256, 258, 260, 399/262, 263, 107
See application file for complete search history.

(56) References Cited

U.S. PATENT DOCUMENTS 6,360,066 B1 3/2002 Kawahito et al.
6,415,125 B1 7/2002 Yamamoto et al.
6,415,126 B1 * 7/2002 Kaneshige et al. ..... 399/256
2003/0202823 A1 * 10/2003 Tamura ..... 399/227

FOREIGN PATENT DOCUMENTS

EP 1 202 127 5/2002
JP 59216168 12/1984

* cited by examiner

*Primary Examiner*—Hoan Tran
(74) *Attorney, Agent, or Firm*—Schiff Hardin LLP

(57) ABSTRACT

In a device and method for developing a charge image on a photoconductor of an electrophotographic printer or copier, a developer chamber is provided having a first and a second end in which at least a portion of the developer is contained. A mixer is provided for thoroughly mixing the developer in the developer chamber. The mixer generates a flow of the developer that is directed from a first end of the developer chamber to a second end. An inlet for developer is provided at the first end of the developer chamber and an overflow is provided at the second end. The developer exits the developer chamber via the overflow when its level in the region of the second end exceeds a prescribed height. A conveyor conveys the developer that has exited the developer chamber at the overflow toward the inlet.

17 Claims, 3 Drawing Sheets

FIG. 2
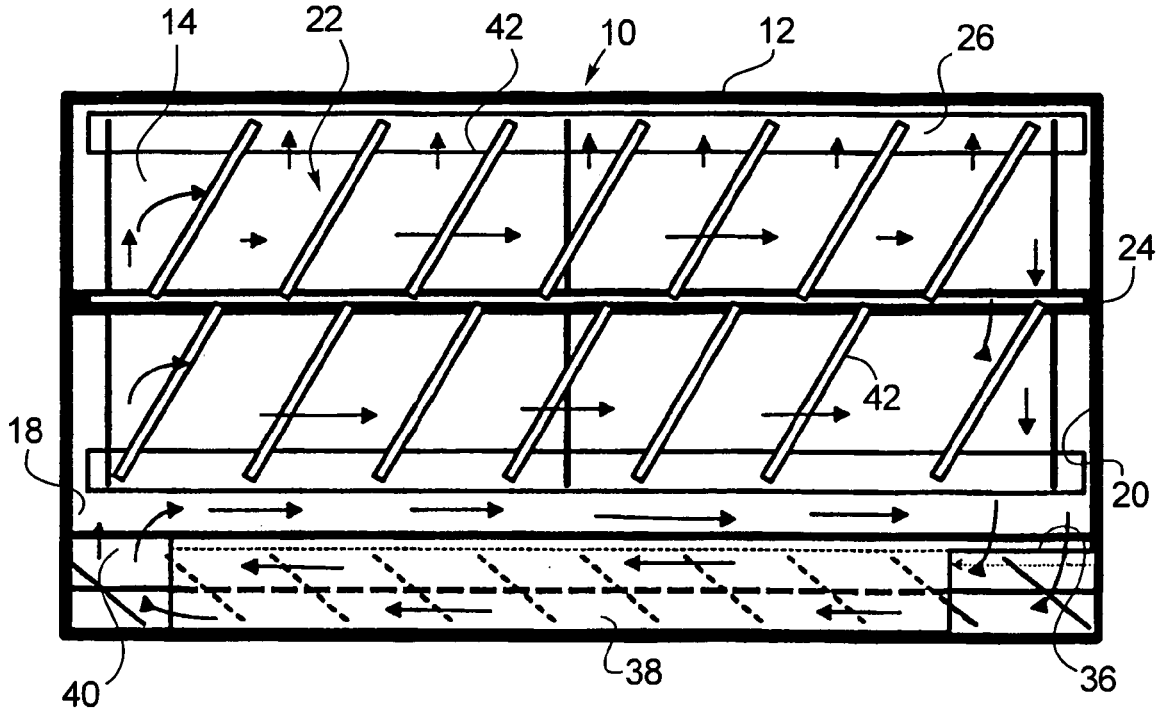
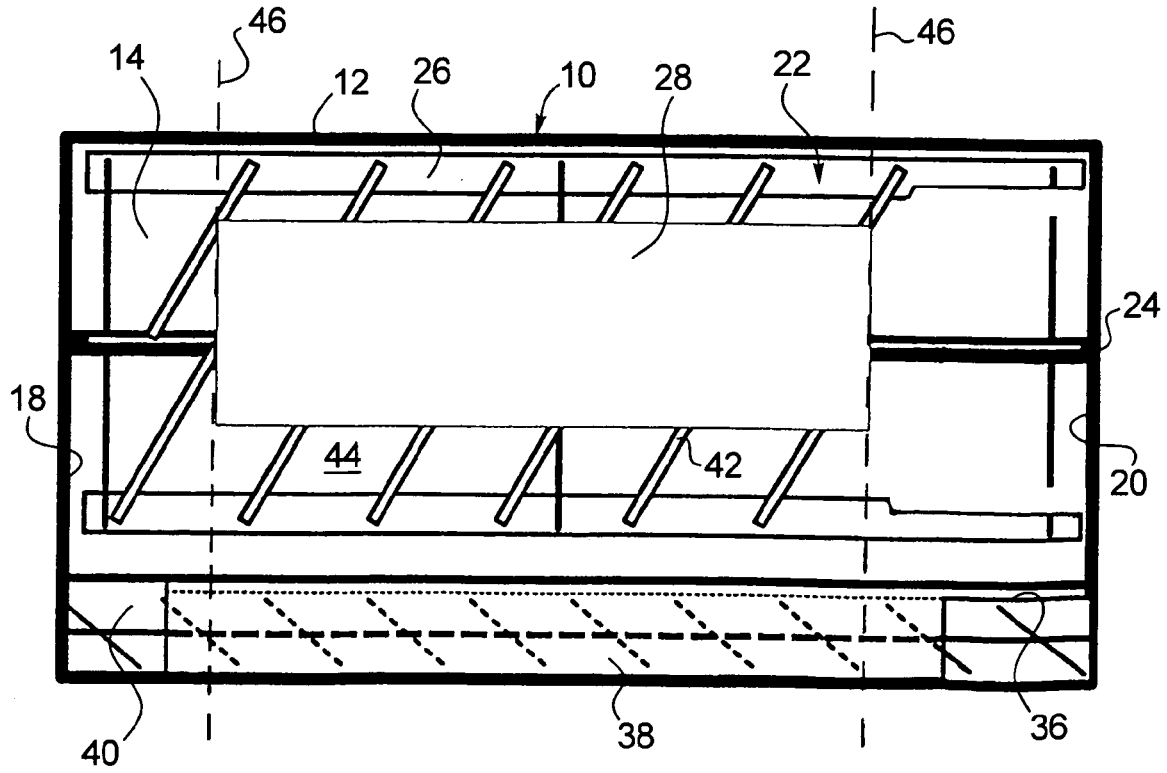
FIG. 3

DEVICE AND METHOD FOR DEVELOPING A CHARGE IMAGE

BACKGROUND

The present system relates to a device for developing a charge image on a photoconductor of an electrophotographic printer or copier. A developer chamber has a first end and a second end. In the chamber at least a portion of the developer is contained. A mixing unit is provided for thoroughly mixing the developer in the developer chamber. The system further relates to a method for developing a charge image on a photoconductor of a printer or copier.

During the development of a charge image on a photoconductor, the developer is either applied to the charged areas of the photoconductor (in the so-called charged area development) or to the discharged areas of the photoconductor (in the so-called discharged area development). For example, a mixture of toner particles and magnetic carrier particles is used as a developer. During the thorough mixing of the developer in the developer chamber, the toner particles and the carrier particles are tribo-electrically charged by means of friction, as a result whereof the toner is charged as required for its application to the charge image. The magnetic carrier particles can be applied to the photoconductor with the aid of magnetic rollers, whereupon the toner particles adhering to the carrier particles are transferred from the carrier particles onto the charge image of the photoconductor. However, the system is not restricted to such developer mixtures but can, for example, also be used for one-component developers.

The mixing unit of the device is a multiple function mixing unit. On the one hand, it serves to thoroughly mix the developer in the developer chamber such that there results an almost uniform developer filling level over the entire width of the developer chamber. Width refers to the dimension of the developer chamber that is transverse to the direction of motion of the photoconductor relative to the developing device. It is important to have an at least almost uniform developer filing level over the width of the developer chamber to guarantee that the entire width of a roller or of several rollers applying the developer to the photoconductor is brought into contact with the developer so that the charge image on the photoconductor is developed completely and uniformly.

In case the developer comprises of a mixture of toner and carrier particles, toner particles have to be supplied to the mixture by the same amount as taken from the developer mixture during development of the charge image. This amount of toner supplied has to be mixed in evenly by the mixing unit, since an inhomogeneous mixture of toner and carrier particles would result in an inhomogeneous optical density of the print image. Finally, the mixing unit has to thoroughly mix the developer mixture such that the developer is activated, i.e. that the toner particles are sufficiently charged.

An at least almost uniform developer filling level over the width of the developer chamber is likewise significant with respect to a uniform charging of the developer mixture, since a varying filling level results in a varying mixing behavior and consequently in a non-uniform charging of the developer mixture.

In known developing devices, the mixing unit is formed by a so-called paddle wheel which is arranged in the developer chamber and the axis of which runs in the transverse direction of the developer chamber, i.e. transverse to the direction of motion of the photoconductor relative to the developer chamber. The paddle wheel has paddle-like or shovel-like blades, by means of which the developer is thoroughly mixed upon rotation of the paddle wheel.

While it is possible to efficiently circulate the developer by means of such a paddle wheel, it is relatively difficult to thoroughly mix the developer in the transverse direction, i.e. along the axis of the paddle wheel, in an efficient way. The difficulty in thoroughly mixing in the transverse direction is that, in spite of the thorough mixing in the transverse direction, the filling level has to remain at least almost the same over the width of the developer chamber. As a result thereof, the developer has to be thoroughly mixed in the transverse direction such that there is no net flow of developer in the transverse direction.

The prior art discloses paddle wheels having radially outer blades, which generate a toner flow in a transverse direction, and having radially inner blades, which generate a toner flow in the opposite transverse direction. These radially inner and radially outer blades are designed such that the developer mixture is transported in both transverse directions at the same transport rate so that no net flow of developer mixture in the transverse direction occurs and thus the filling level of the developer in the developer chamber remains at least almost constant in time over the width of the developer chamber.

In order to achieve an efficient thorough mixing in the transverse direction without or with a low net flow in the transverse direction, both the revolutions per minute of the paddle wheel as well as the flow properties of the developer must be very close to a desired value for which the paddle wheel is designed. If the revolutions per minute of the paddle wheel or the flow properties of the developer even only moderately deviate from the desired value, in conventional developing units already a net flow of the developer in the developer chamber occurs and results in an accumulation of developer on one side only, and therefore in deterioration of the developing quality.

Since the flow properties of a developer mixture of toner and carrier particles vary with the toner concentration, in known devices the toner concentration in the mixture has to be kept very close to a desired value at relatively great expense in order to not deteriorate the thorough mixing in the transverse direction. This not only requires great expense but also prohibits the control of the optical density of the print image by means of the toner concentration, which is a significant restriction. In addition, the flow properties of the developer mixture are also dependent on climatic conditions which can only be influenced in a limited way, this resulting in an uncontrolled deterioration of the mixing behavior in the transverse direction. Accordingly, a uniform efficient thorough mixing in the transverse direction is difficult to be carried out with conventional means and is very disturbance-sensitive.

SUMMARY

It is an object to provide a device and a method which allow a uniform and stable thorough mixing of the developer in the transverse direction.

This object is solved wherein the mixing unit generates a developer flow that is directed from the first end of the developer chamber toward the second end. An inlet for developer is provided at the first end and an overflow is provided at the second end. Via the overflow, the developer exits the developer chamber when its level in the region of the second end exceeds a prescribed height. A conveyor is provided to convey the developer which overflows back to the inlet end.

BRIEF DESCRIPTION OF THE DRAWINGS

FIG. 2 is a top view of the developing device of FIG. 1 without developer roller;

FIG. 3 is a top view of a developing device with developer roller;

DESCRIPTION OF THE PREFERRED EMBODIMENTS

Figure 1:
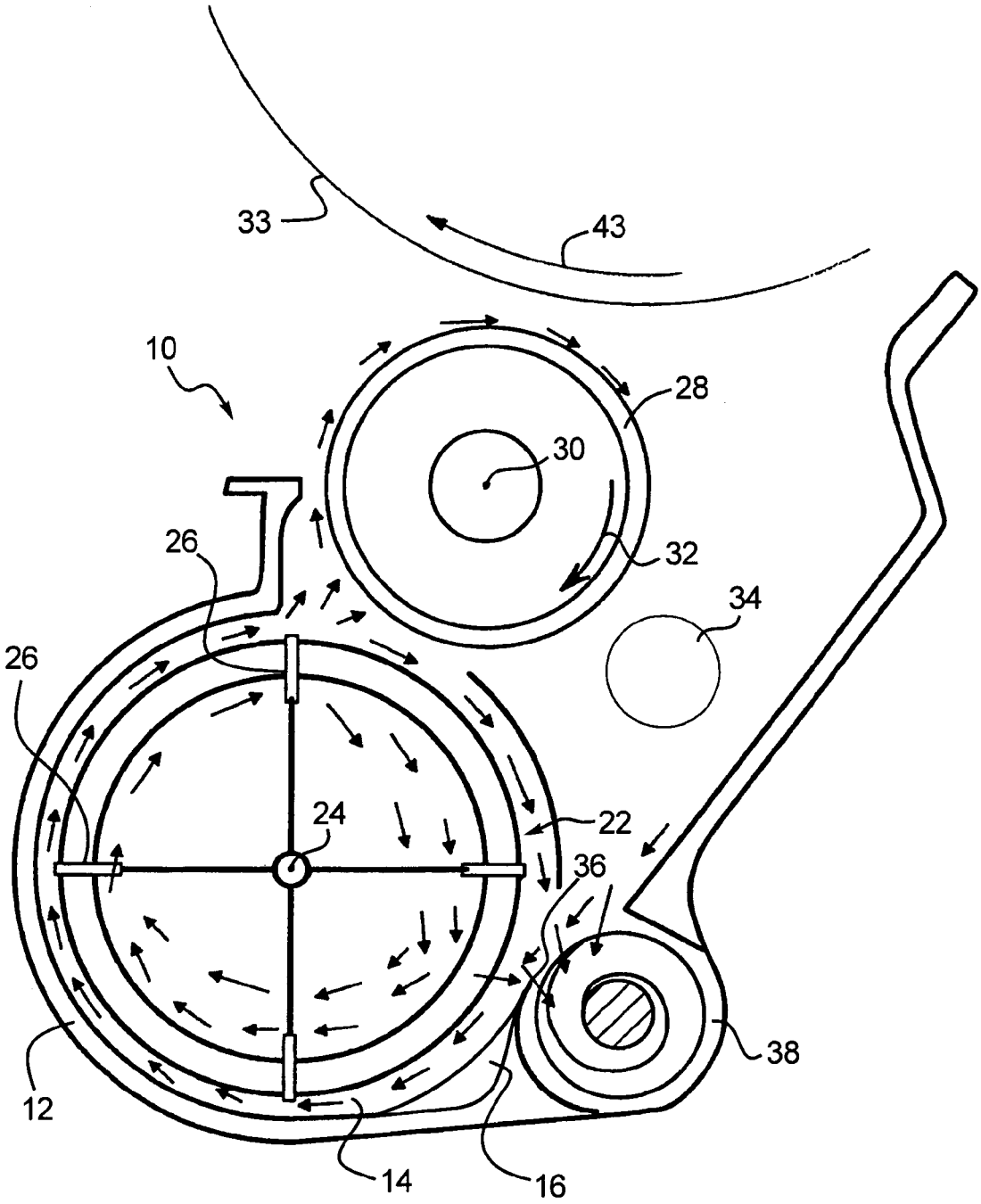
FIG. 1 is a schematic cross-sectional view of a developing device in the region of a second end.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Instead of providing a mixing unit that generates two opposite developer flows in order to achieve a thorough mixing in the transverse direction without a net flow, a developer flow from the first end toward the second end of the developer chamber is generated during the mixing of the developer. In the course of this, the developer is thoroughly mixed in an efficient way.

In spite of the developer flow, the developer does not accumulate at the second end of the developer chamber since it exits the developer chamber at the overflow as soon as it reaches a prescribed level. Likewise, there is no lack of developer at the first end of the developer chamber since the developer that has exited at the overflow is conveyed to the inlet, through which it is re-supplied into the developer chamber at its first end.

When the conveying capacity of the conveyor is designed so high that no developer piles up in the conveyor, the developer being introduced at the inlet at the same rate as it exits at the overflow. As a result thereof, a dynamic equilibrium of the developer flow in the developer chamber is reached, as a consequence of which the filling level is at least almost constant in time over the entire width of the developer chamber.

The dynamic equilibrium is also reached in the case of a fluctuating or varying developer flow rate, which could, for example, result from a change in the flow properties of the developer or from power fluctuations of the mixing unit. Even though the exit rate and the inlet rate of the developer can vary with the flow rate, the exit rate and the inlet rate always remain identical with respect to one another. As a result thereof, a uniform filling level is reached over the entire width of the developer chamber independent of the flow properties of the developer.

With the device and the method, not only a uniform filling level is reached in the developer chamber but also fluctuations in volume of the developer mixture are compensated for. Such fluctuations in volume, for example, are accompanied by fluctuations in the toner concentration and, in the case of conventional devices, they result in fluctuations in the degree of activation of the developer mixture.

In FIG. 1 a schematic cross-section view and in FIG. 2 a top view of a device 10 for developing a charge image on a photoconductor 33 of an electrophotographic printer or copier is shown. As can be seen in FIGS. 1 and 2, the device 10 comprises a housing 12 that defines a developer chamber 14 in which a developer mixture 16 of toner and carrier particles is contained. In FIGS. 1 and 2, the flow of the developer 16 in the device 10 is schematically illustrated by arrows.

As shown in FIG. 2, the developer chamber 14 has a first end 18 and a second end 20. The view of FIG. 1 is a cross-section of the developing device 10 in the region of the second end 20, as viewed from the first end 18 toward the second end 20 of the developer chamber 14.

In the developer chamber 14 a paddle wheel 22 is rotatably mounted about an axis 24. The axis 24 runs between the first end 18 and the second end 20 of the developer chamber 14. The paddle wheel 22 has blades 26 which are arranged parallel to the axis 24 of the paddle wheel, as well as blades 42 which are inclined with respect to the axis 24.

Above the paddle wheel 22, a developer roller 28 which is rotatable about an axis 30 in the direction indicated by the arrow 32 is shown in FIG. 1. The developer roller 28 is omitted in FIG. 2. Inside the developer roller 28 static magnets (not illustrated) having an alternating pole arrangement are provided. The carrier particles of the developer mixture 16 are magnetic and align themselves along the lines of force of the magnets of the developer roller 28, and cover the circumferential surface of the developer roller 28. As a result thereof, brush-like structures of the developer, so-called "magnetic brushes" form on the surface of the developer roller 28 due to the form of the magnetic lines of force, by means of which brushes the developer is applied to the photoconductor drum 33 which is shown only in part in FIG. 1. Instead of the single developer roller 28, several transport or magnetic rollers can be provided, which, in a manner known per se, jointly apply the toner to the photoconductor drum 33.

Further, a toner feed opening 34 through which toner can be fed to the developer mixture 16 in the developer chamber 14 by the same amount as removed from the developer mixture 16 during the development of the charge image is shown in FIG. 1.

At the second end 20 of the developer chamber 14 an overflow 36 is provided. When the filling level, i.e. the level of the developer mixture 16 in the developer chamber 14, exceeds a predetermined value in the region of the second end 20, the developer mixture exits the developer chamber 14 at the overflow 36. A conveyor 38, which, in the illustrated embodiment, is formed by a conveyor screw, is adjacent to the overflow 36. The developer exiting the developer chamber at the overflow 36 is transported by means of the conveyor screw 38 outside the developer chamber 14 directly to a developer inlet 40, which is provided at the first end 18 of the developer chamber (see FIG. 2).

The paddle wheel 22 of the developing device 10 forms a mixing unit, the function of which is described in the following. When the paddle wheel 22 rotates clockwise in the illustration of FIG. 1, the developer mixture is thoroughly mixed by the blades 26 which are parallel to the paddle wheel axis 24. By means of this mixing motion of the paddle wheel 22, toner that is supplied via the toner feed opening 34 is mixed into the developer mixture 16, and the toner on the carrier particles is tribo-electrically charged. Further, the blades 26 feed the developer 16 to the developer roller 28 (FIG. 1).

As can be seen in FIG. 2, the paddle wheel 22 further has a plurality of blades 42 which are inclined with respect to the paddle wheel axis 24. Upon a rotation of the paddle wheel 22, these blades generate a flow of the developer 16 in the developer chamber 14, which flow is directed from the first end 18 to the second end 20 of the developer chamber 14 and is indicated in FIG. 2 by the arrows pointing to the right. By means of this flow, the developer mixture is thoroughly mixed in the direction pointing from the first end 18 to the second end 20 of the developer chamber 14. In the illustrated embodiment, this direction corresponds to the transverse direction of the developer chamber 14. The transverse direction of the developer chamber 14 is transverse to the direction of the relative movement of the photoconductor 33 (FIG. 1) indicated by the arrow 43 shown in FIG. 1.

Such a thorough mixing of the developer 16 in the transverse direction is of greatest importance. Without an efficient thorough mixing of the developer 16 in the transverse direction, fluctuations in the toner concentration in the transverse direction can arise, and these fluctuations would become noticeable in the image in a disturbing way in the form of brightenings. But as important as a thorough mixing of the developer mixture 16 in the transverse direction is that the filling level of the developer in the developer chamber 14 in the transverse direction, i.e. over the width thereof, is at least almost constant. Should the filling level become too high at one point, a developer jam may result which can damage the movable parts and in particular the paddle wheel 22. When, in contrast, the filling level drops too low at one point, the film of developer mixture on the developer roller 28 can tear open as a result of an insufficient application of developer, this resulting in an incomplete development of the charge image on the photoconductor 33. In conventional developing devices, the great difficulty is to provide at the same time an efficient thorough mixing in the transverse direction and an at least almost uniform filling level over the entire width of the developer chamber 14.

In the embodiment illustrated in FIGS. 1 and 2, an at least almost uniform filling level of the developer 16 in the developer chamber 14 is achieved by a continuous flow of the developer from the first end 18 toward the second end 20. As soon as the level of the developer 16 in the region of the second end 20 reaches the height of the overflow 36, the developer exits the developer chamber 14 at the overflow 36. The exited developer 16 is transported to the inlet 40 by the conveying means 38. The conveying capacity of the conveyor 38 is rated such that it exceeds the flow that can be generated at most by the paddle wheel 22 so that the conveyor 38 can transport the developer exiting at the overflow 36 to the inlet 40 without delay. As a consequence thereof, the exit rate of the developer at the overflow 36 and the inlet rate of the developer at the inlet 40 are always at least almost the same, as a result whereof a continuous flow, i.e. a dynamic equilibrium is reached in the developer chamber.

This dynamic equilibrium is reached independent of the flow rate of the developer mixture 16 in the developer chamber 14. If the flow of the developer is, for example, varied by changes in the flow properties of the developer (for example due to climatic changes or changes in the toner concentration) or by fluctuations in the revolutions per minute of the paddle wheel 22, a dynamic equilibrium is nevertheless reached because the exit rate of the developer 16 at the overflow 36 and the inlet rate of the developer 16 at the inlet 40 are always identical with respect to one another, even if their current value varies as a consequence of a higher or lower flow rate of the developer 16 in the developer chamber 14.

FIG. 3 is a top view of a developing unit 10 which is substantially identical to the one shown in FIGS. 1 and 2 and in which identical parts have the same reference characters. In the developing unit 10 of FIG. 3, the developing roller 28 is shown. The vertical projection of the developer roller 28 on the developer chamber 14 defines a middle section 44 of the developer chamber 14 between the two broken lines 46 in FIG. 3, from which section the developer 16 which will be applied to the photoconductor is taken. The paddle wheel 22 is designed such that it generates a uniform flow of developer at least in the middle section 44 of the developer chamber 14.

As can be seen in FIG. 3, both the inlet 40 and the overflow 36 are located outside the middle section 44. This means that a possibly irregular flow of developer in the region of the inlet 40 and the overflow 36 has no influence on the print quality because from these regions no toner is taken for application to the photoconductor 33. As can further be seen in FIG. 3, the developer chamber 14 is clearly wider than the developer roller 28, and thus also wider than the photoconductor 33 which is approximately as wide as the developer roller 28. Therefore, the region available for thoroughly mixing the developer 16 is enlarged, and this results in a better thorough mixing. Moreover, a larger amount of developer can be introduced into the developer chamber 14, as a result whereof the life of the developer is increased.

The paddle wheel 22 of the embodiment of FIG. 3 has no inclined blades 42 in the region of the overflow 36. The reason is that in the region of the overflow 36 a transverse conveying is not necessary. Instead, in the region of the overflow 36, the developer should be kept on a certain level as smoothly as possible. For this reason, the blades 26 in the region of the overflow 36 are narrower than in the remaining part of the paddle wheel 22. The developer 16 should flow as uniformly as possible over the overflow 36 but not be thrown into the overflow 36 by the paddle wheel 22.

Figure 4:
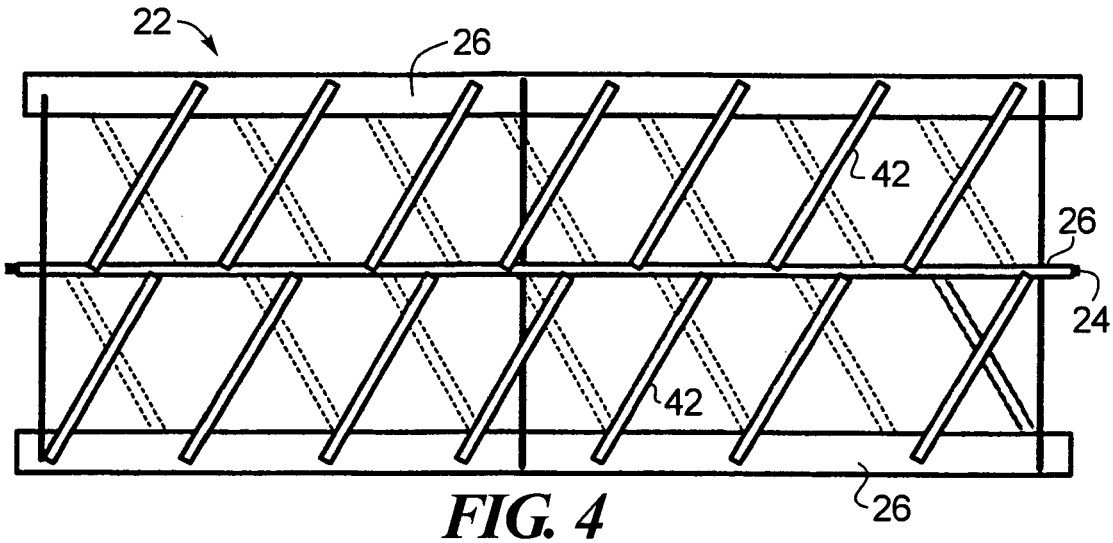
FIG. 4 shows the paddle wheel of the mixing unit of the developing device of FIGS. 1 and 2.

In FIG. 4, the paddle wheel 22 of FIGS. 1 and 2 is illustrated once again separately. As already described above, the paddle wheel 22 has blades 26 which are arranged parallel to the axis 24 of the paddle wheel 22, and blades 42 which are inclined with respect to the axis 24. The blades 26 serve to thoroughly mix the developer 16 and to feed the developer 16 to the developer roller 28. The inclined blades 42 serve to transport the developer mixture 16 in the transverse direction, i.e. to generate a developer flow from the first end 18 of the developer chamber 14 toward the second end 20 thereof.

Figure 5:
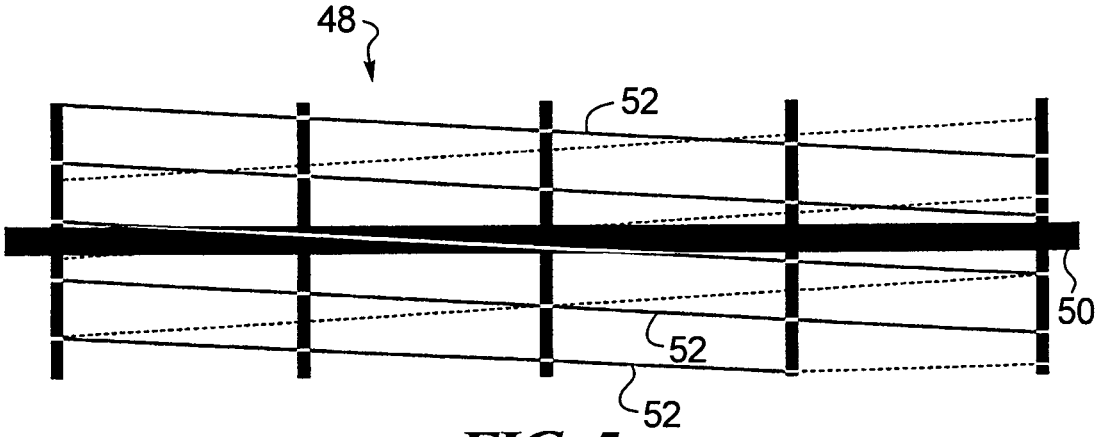
FIG. 5 shows an alternative embodiment of a paddle wheel.

In FIG. 5, an alternative embodiment 48 of a paddlewheel is shown. The paddle wheel 48 of FIG. 5 has an axis 50, which is surrounded by blades 52 in a screw-like manner. Due to their inclined position with respect to the axis 50, the blades 52 likewise generate a flow of the developer 16 in the transverse direction, and at the same time they serve to thoroughly mix the developer 16 and to feed the developer 16 to the developer roller 28.

Figure 6:
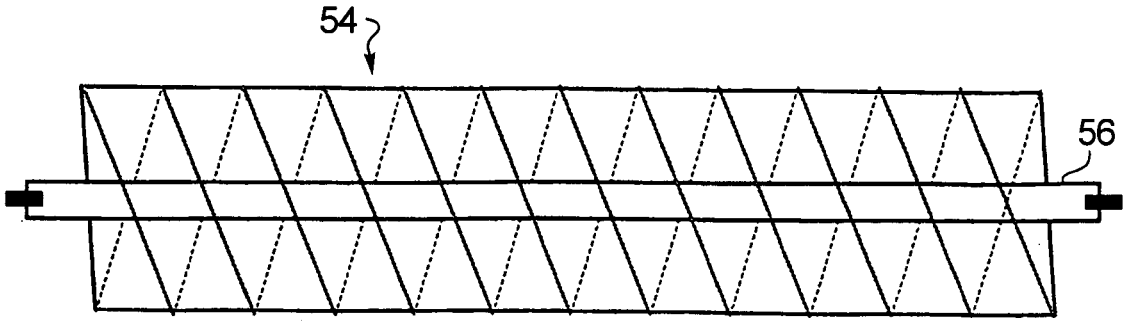
FIG. 6 is a schematic illustration of a rotatable screw, which is used as a mixing unit in an alternative embodiment.

Instead of a paddle wheel 22 or 48, the mixing unit of the developing device 10 can also be formed by a conveying screw, as schematically illustrated in FIG. 6. Apart from the illustrated preferred embodiments, many different forms of paddle wheels are conceivable for the mixing unit of the developing device 10, as long as they provide a sufficient thorough mixing of the developer 16, a sufficient flow of the developer 16 from the first end of the developer chamber 18 to its second end 20 and preferably feed the developer 16 to the developer roller 28.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A device for developing a charge image on a photoconductor of an electrophotographic printer or copier, comprising:

a developer chamber having a first end and a second end and in which at least a portion of the developer is contained;

a mixer thoroughly mixing the developer in the developer chamber;

the mixer generating a flow of the developer directed from the first end of the developer chamber to the second end;

an inlet for the developer at the first end;

an overflow at the second end via which overflow the developer exits the developer chamber when its level in a region of the second end exceeds a prescribed height;

a conveyor which conveys toward the inlet developer that has exited the developer chamber at the overflow; and a conveying capacity of the conveyor exceeding the flow of the developer that can be generated by the mixer.

2. A device according to claim 1 wherein the flow of the developer in the developer chamber is directed transversely to a direction of motion of the photoconductor relative to the device.

3. A device according to claim 1 wherein the developer exiting at the overflow is directly conveyed to the inlet.

4. A device according to claim 1 further comprising at least one developer roller which applies the developer to the photoconductor, and in which the mixer applies the developer to a developer roller.

5. A device according to claim 1 wherein the mixer comprises an element rotatable about an axis running between the first and the second end of the developer chamber, said element having shovel-like elements.

6. A device according to claim 5 wherein the shovel-like elements are formed by blades.

7. A device according to claim 6 in which some of the blades are arranged parallel to the axis of the rotatable element.

8. A device according to claim 6 wherein which at least one of the blades is inclined with respect to the axis of the rotatable element.

9. A device according to claim 8 wherein the at least one blade that is inclined with respect to the axis of the rotatable element surrounds the axis in screw-like fashion.

10. A device according to claim 1 wherein the mixer is formed by a screw which is rotatable about an axis running between the first and the second end of the developer chamber.

11. A device according to claim 1 wherein the conveyor comprises a conveyor screw.

12. A device according to claim 1 wherein the developer applied to the photoconductor is taken from a middle section of the developer chamber, and in which the inlet and the overflow are provided outside the middle section of the developer chamber.

13. A device for developing a charge image on a photoconductor of an electrophotographic printer or copier, comprising:

a developer chamber having a first end and a second end and in which at least a portion of the developer is contained;

a mixer thoroughly mixing the developer in the developer chamber;

the mixer generating a flow of the developer directed from the first end of the developer chamber to the second end;

an inlet for the developer at the first end;

an overflow at the second end via which overflow the developer exits the developer chamber when its level in a region of the second end exceeds a prescribed height;

a conveyor which conveys toward the inlet developer that has exited the developer chamber at the overflow; and the mixer being designed such that it generates a flow in a region of the second end of the developer chamber that is lower than a flow in a middle section of the developer chamber.

14. A method for developing a charge image on a photoconductor of an electrophotographic printer or copier, comprising the steps of:

with aid of a mixer, thoroughly mixing a developer in a developer chamber and generating a flow of the developer directed from a first end of the developer chamber to a second end;

having the developer exit via an overflow provided at the second end when its level in a region of the second end exceeds a predetermined height;

conveying the developer that has exited at the overflow with a conveyor to an inlet provided at the first end of the developer chamber, and introducing the developer into the developer chamber via the inlet; and wherein a conveying capacity of the conveyor exceeds the flow of the developer that is generated by the mixer.

15. A method according to claim 14 wherein the developer is applied to a developer roller with the mixer, and the developer roller applies the developer to the photoconductor.

16. A method according to claim 14 wherein the developer applied to the photoconductor is taken from a middle section of the developer chamber, the inlet and the overflow being arranged outside the middle section of the developer chamber.

17. A method for developing a charge image on a photoconductor of an electrophotographic printer or copier, comprising the steps of:

with aid of a mixer, thoroughly mixing a developer in a developer chamber and generating a flow of the developer directed from a first end of the developer chamber to a second end, the mixer generating a flow in a region of the second end of the developer chamber that is lower than in a middle section of the developer chamber;

having the developer exit via an overflow provided at the second end when its level in a region of the second end exceeds a predetermined height; and conveying the developer that has exited at the overflow with a conveyor to an inlet provided at the first end of the developer chamber, and introducing the developer into the developer chamber via the inlet.

* * * * *